US008769998B1

(12) United States Patent
MacConnell

(10) Patent No.: US 8,769,998 B1
(45) Date of Patent: Jul. 8, 2014

(54) BIASED CUFF ASSEMBLY

(71) Applicant: Chad A. MacConnell, Vero Beach, FL (US)

(72) Inventor: Chad A. MacConnell, Vero Beach, FL (US)

( * ) Notice: Subject to any disclaimer, the term of this patent is extended or adjusted under 35 U.S.C. 154(b) by 0 days.

(21) Appl. No.: 13/913,866

(22) Filed: Jun. 10, 2013

(51) Int. Cl.
*E05B 75/00* (2006.01)

(52) U.S. Cl.
CPC ..... *E05B 75/00* (2013.01)
USPC ..... 70/16

(58) Field of Classification Search
CPC .... E05B 75/00; E05B 75/005; E05B 15/0046
USPC ..... 70/14–19; 24/16 PB; 119/816, 819; 128/878, 879
See application file for complete search history.

(56) References Cited

U.S. PATENT DOCUMENTS 2,516,878 A * 8/1950 Howe ..... 70/16
2,772,553 A * 12/1956 Howe ..... 70/16
2,948,139 A * 8/1960 Howe ..... 70/16
4,314,466 A 2/1982 Harris
5,138,852 A * 8/1992 Corcoran ..... 70/16
5,823,020 A * 10/1998 Benda ..... 70/18
6,904,775 B2 6/2005 Makos et al.
7,171,829 B2 * 2/2007 Parsons et al. ..... 70/16
7,251,964 B2 8/2007 Wade
7,316,137 B2 1/2008 Parsons
2007/0256461 A1 * 11/2007 Parsons et al. ..... 70/16
2007/0289342 A1 12/2007 Brooks et al.
2010/0206017 A1 8/2010 Garibaldi

* cited by examiner

*Primary Examiner* — Lloyd Gall

(57) ABSTRACT

A biased cuff assembly comfortably but securely cuffs extremities of a person. The assembly includes a cuff having a first arcuate section hingedly coupled to a second arcuate section configured to form a closed loop to secure the cuff to an extremity of a person. A sheath is pivotally coupled to the first arcuate section of the cuff. The first arcuate section of the cuff is positioned in a slot in the sheath. The sheath has an arcuate edge extending into an opening of the loop when the sheath is in a retracted position wherein the arcuate edge of the sheath is configured to contact the extremity extending through the loop. A biasing member is coupled to the first arcuate section of the cuff and positioned to bias the sheath to pivot outwardly away from the opening of the loop.

6 Claims, 4 Drawing Sheets

BIASED CUFF ASSEMBLY

BACKGROUND OF THE DISCLOSURE

Field of the Disclosure

The disclosure relates to cuffing devices and more particularly pertains to a new cuffing device for comfortably but securely cuffing extremities of a person.

SUMMARY OF THE DISCLOSURE

An embodiment of the disclosure meets the needs presented above by generally comprising a cuff having a first arcuate section hingedly coupled to a second arcuate section. A hinge couples the first arcuate section to the second arcuate section. A slit extends through the first arcuate section. A free end of the second arcuate section is insertable into the slit and engageable to the first arcuate section forming a closed loop configured for securing the cuff to an extremity of a person. A sheath is pivotally coupled to the first arcuate section of the cuff. The first arcuate section of the cuff is positioned in a slot in the sheath. The sheath has an arcuate edge extending into an opening of the loop when the sheath is in a retracted position wherein the arcuate edge of the sheath is configured to contact the extremity extending through the loop. A biasing member is coupled to the first arcuate section of the cuff and positioned to bias the sheath to pivot outwardly away from the opening of the loop.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
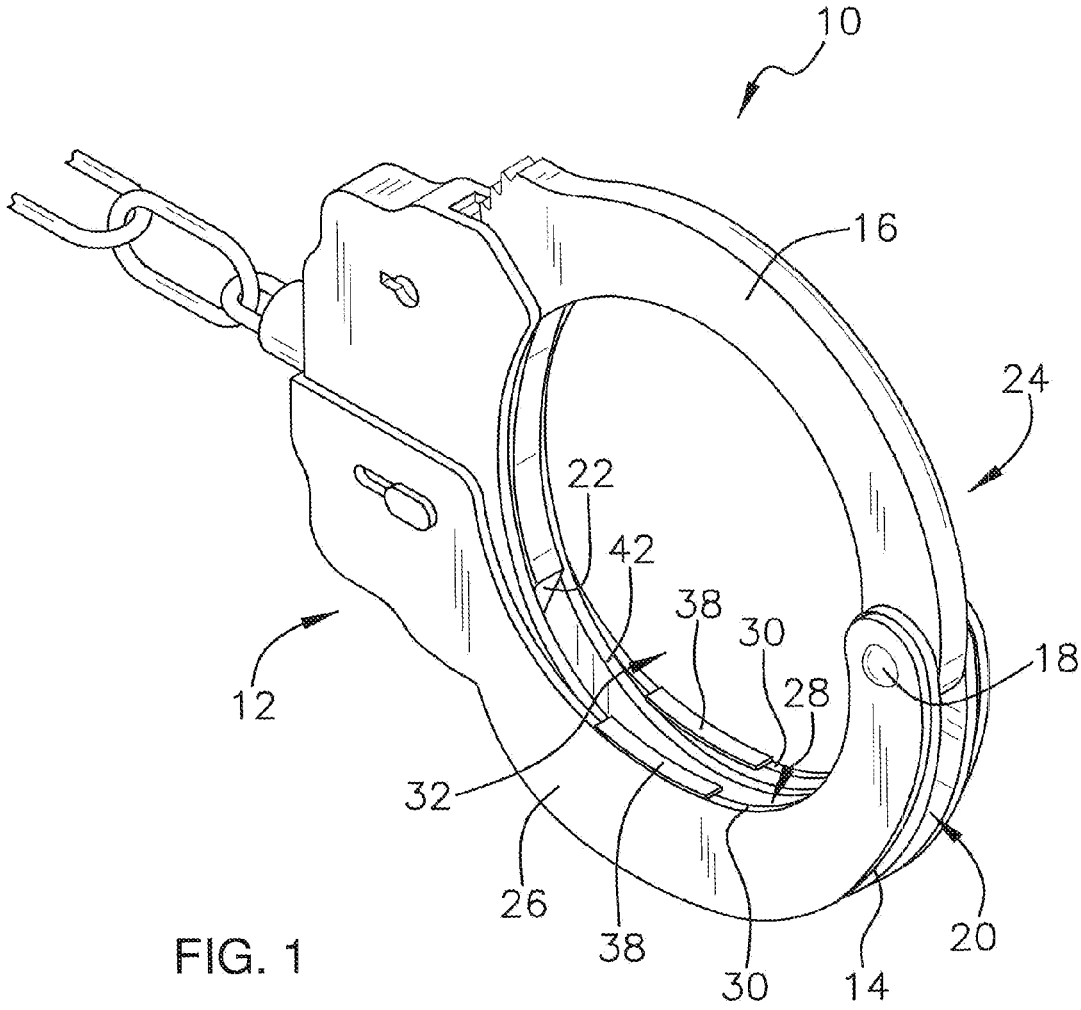
FIG. 1 is a top front side perspective view of a biased cuff assembly according to an embodiment of the disclosure.
Figure 3:
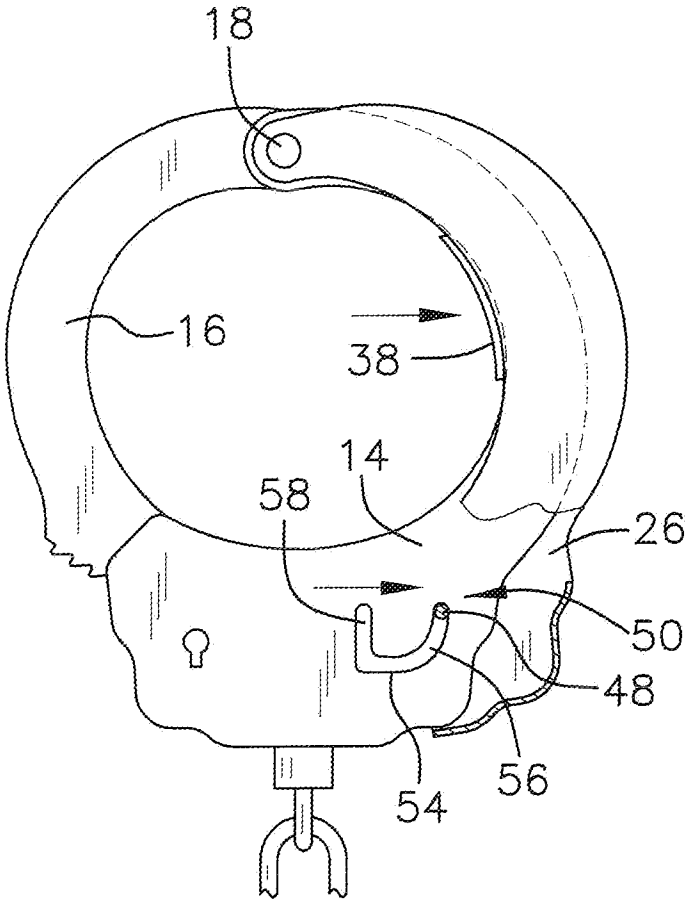
FIG. 3 is a partial cut-away front view of an embodiment of the disclosure in a relaxed position.
Figure 2:
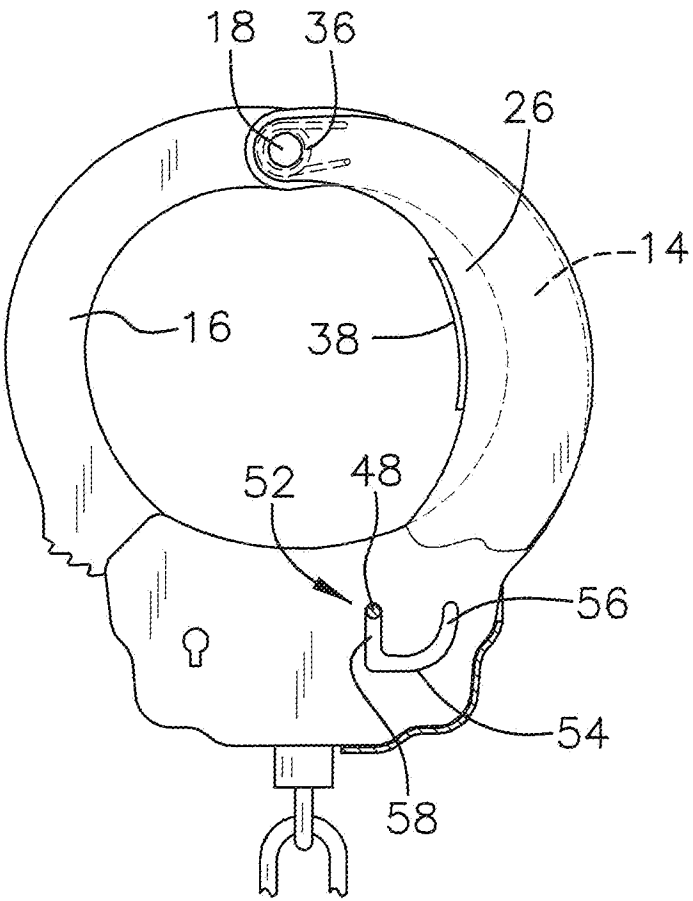
FIG. 2 is a partial cut-away front view of an embodiment of the disclosure in a compressed position.
Figure 4:
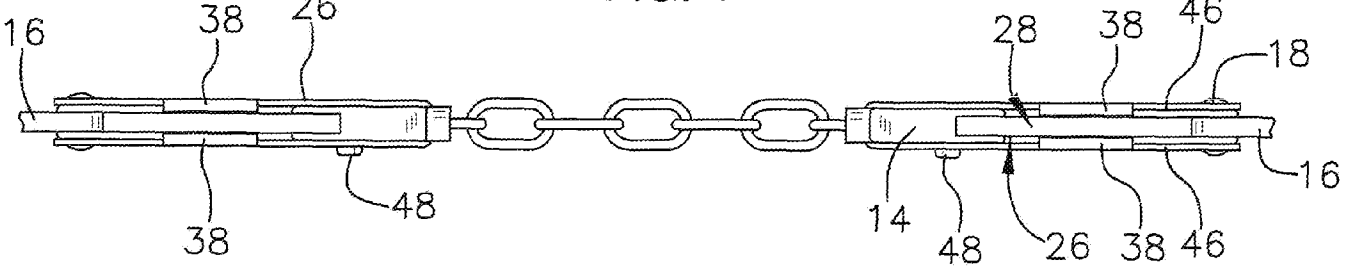
FIG. 4 is a top view of an embodiment of the disclosure.
Figure 5:
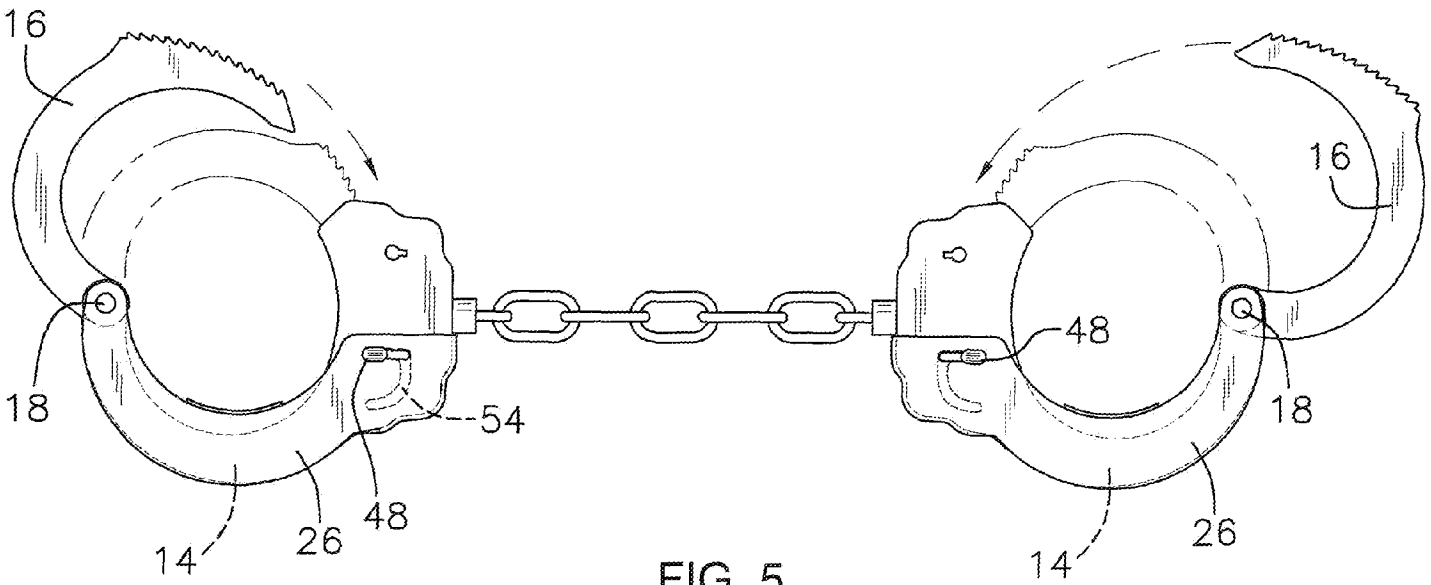
FIG. 5 is a front view of an embodiment of the disclosure.
Figure 7:
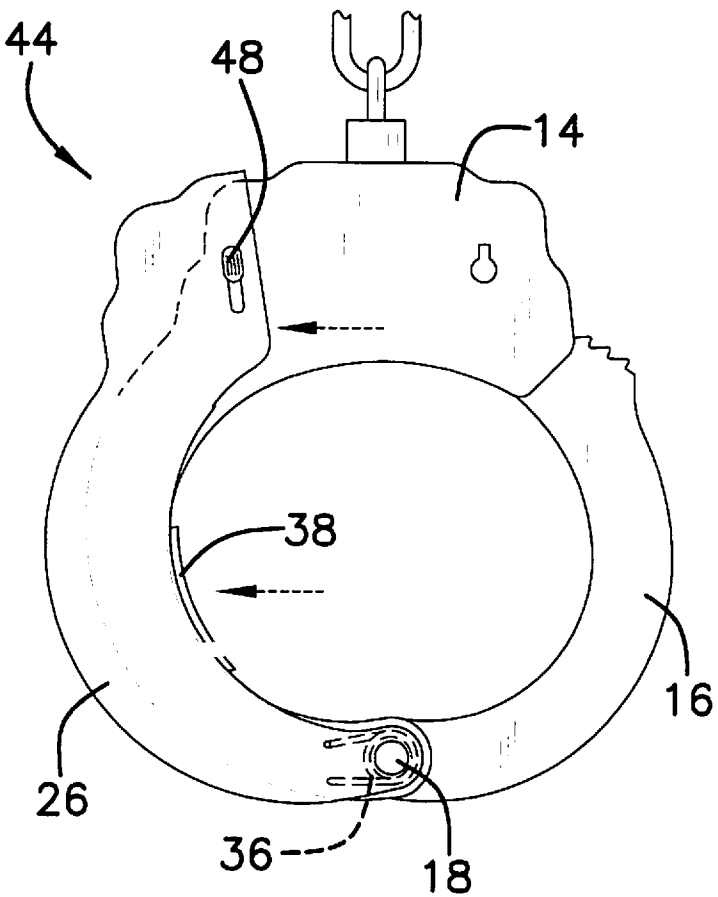
FIG. 7 is a front view of an embodiment of the disclosure in the relaxed position.
Figure 6:
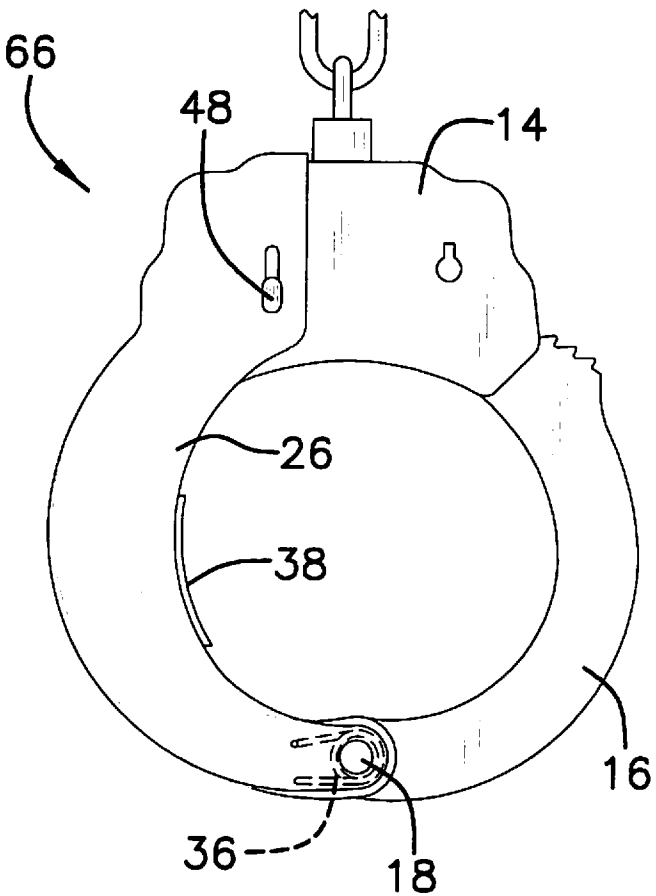
FIG. 6 is a front view of an embodiment of the disclosure in the compressed position.

With reference now to the drawings, and in particular to FIGS. 1 through 7 thereof, a new cuffing device embodying the principles and concepts of an embodiment of the disclosure and generally designated by the reference numeral 10 will be described.

As best illustrated in FIGS. 1 through 7, the biased cuff assembly 10 generally comprises a cuff 12 having a first arcuate section 14 hingedly coupled to a second arcuate section 16. A hinge 18 couples the first arcuate section 14 to the second arcuate section 16. A slit 20 extends through the first arcuate section 14 and a free end 22 of the second arcuate section 16 is insertable into and through the slit 20 and engageable to the first arcuate section 14 forming a closed loop 24 configured for securing the cuff 12 to an extremity of a person in the manner of an otherwise conventional cuff of the type commonly used in law enforcement.

A sheath 26 is substantially shaped to conform to the exterior shape of the first arcuate section 14 of the cuff 12. The sheath 26 is pivotally coupled to the first arcuate section 14 of the cuff 12. The sheath 26 has a longitudinal slot 28 aligning with the first arcuate section 14 such that the first arcuate section 14 of the cuff 12 is positionable in the slot 28. A portion of the slot 28 extends fully through the sheath 26 aligned with the slit 20 in the first arcuate section 14 to permit the second arcuate section to extend through the slit 20 and the slot 28. The sheath 26 has an arcuate edge 30 extending into an opening 32 of the loop 24 when the sheath 26 is in a retracted position 66 wherein the arcuate edge 30 of the sheath 26 is configured to contact the extremity extending through the loop 24. Thus, the arcuate edge 30 of the sheath 26 provides spacing in the loop 24 between the extremity and the first arcuate section 14. The sheath 26 may be pivotally coupled to the hinge 18 coupling the first arcutate section 14 of the cuff 12 to the second arcuate section 16 of the cuff 12.

A biasing member 36 is coupled to the first arcuate section 14 of the cuff 12. The biasing member 36 is positioned to bias the sheath 26 to pivot outwardly away from a center of the loop 24. The biasing member 36 may be a torsion spring. At least one stopper 38 is coupled to and extends from the arcuate edge 30 of the sheath 26 into the opening 32 of the loop 24 wherein the stopper 38 is positioned to abut the first arcuate section 14 of the cuff 12 along an interior edge 42 when the sheath 26 is biased into a fully extended position 44. There may be two such stoppers 38 substantially aligned and extending from opposite sides 46 of the sheath across the slot 28.

A locking pin 48 is slidably coupled to the first arcuate section 14 of the cuff 12. The locking pin 48 is slidable between a first position 50 and a second position 52. A substantially U-shaped locking slot 54 extends through the first arcuate section 14. The locking pin 48 is positioned in the locking slot 54. The locking slot 54 has a first end section 56 and a second end section 58. The first end section 56 is curved and laterally offset from the second end section 58 such that the sheath 26 is urged into the fully extended position 44 by the biasing member 36 when the locking pin 48 is positioned in the first end section 56. The second end section 58 may be straight to promote retention the locking pin 48 in the second end section 58 when the locking pin 48 is moved out of the first end section 56. When the locking pin 48 is moved into the second end section 58, the sheath 26 is positioned in a fully retracted position 66 when the locking pin 48 is positioned in the second end section 58 of the locking slot 54.

In use, the locking pin 48 is positioned in the second end section 58 of the locking slot 54 to hold the sheath in the fully retracted position 66 as the cuff 12 is placed around the extremity of a person being detained. The arcuate edge 30 of the sheath 26 contacts the extremity allowing the user to then lock the first arcuate section 14 and the second arcuate section 16 into place in the manner conventional to known cuffs. The locking pin 48 may then be moved from the second end section 58 of the locking slot 54 allowing the biasing member 36 to pivot the sheath 26 outwardly providing a consistent amount of spacing in the loop 24 to prevent escape from the cuff 12 while allowing a consistent amount of spacing within the loop 24 to provide some degree of comfort for the person being detained.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A biased cuff assembly comprising:

a cuff having a first arcuate section hingedly coupled to a second arcuate section;

a hinge coupling said first arcuate section to said second arcuate section;

a slit extending through said first arcuate section, a free end of said second arcuate section being insertable into said slit and engageable to said first arcuate section forming a closed loop configured for securing said cuff to an extremity of a person;

a sheath pivotally coupled to said first arcuate section of said cuff, said sheath having a longitudinal slot, said first arcuate section of said cuff being positioned in said slot, said sheath having an arcuate edge extending into an opening of said loop when said sheath is in a retracted position wherein said arcuate edge of said sheath is configured to contact the extremity extending through said loop; and a biasing member coupled to said first arcuate section of said cuff, said biasing member being positioned to bias said sheath to pivot outwardly away from said opening of said loop.

2. The assembly of claim 1, further comprising a stopper coupled to and extending from said arcuate edge of said sheath into said opening of said loop wherein said stopper is positioned to abut said first arcuate section of said cuff when said sheath is biased into a fully extended position.

3. The assembly of claim 1, further comprising:

a locking pin slidably coupled to said first arcuate section of said cuff, said locking pin being slidable between a first position and a second position; and a curved locking slot extending through said first arcuate section, said locking pin being positioned in said locking slot, said locking slot having a first end section and a second end section, said first end section being laterally offset from said second end section such that said sheath is secured in a fully extended position when said locking pin is positioned in said first end section and said sheath is positioned in a fully retracted position when said locking pin is positioned in said second end section of said slot.

4. The assembly of claim 1, further comprising said sheath being pivotally coupled to said hinge coupling said first arcutate section of said cuff to said second arcuate section of said cuff.

5. The assembly of claim 1, further comprising said biasing member being a torsion spring.

6. A biased cuff assembly comprising:

a cuff having a first arcuate section hingedly coupled to a second arcuate section;

a hinge coupling said first arcuate section to said second arcuate section;

a slit extending through said first arcuate section, a free end of said second arcuate section being insertable into said slit and engageable to said first arcuate section forming a closed loop configured for securing said cuff to an extremity of a person;

a sheath pivotally coupled to said first arcuate section of said cuff, said sheath having a longitudinal slot, said first arcuate section of said cuff being positioned in said slot, said sheath having an arcuate edge extending into an opening of said loop when said sheath is in a retracted position wherein said arcuate edge of said sheath is configured to contact the extremity extending through said loop, said sheath being pivotally coupled to said hinge coupling said first arcutate section of said cuff to said second arcuate section of said cuff;

a biasing member coupled to said first arcuate section of said cuff, said biasing member being positioned to bias said sheath to pivot outwardly away from said opening of said loop, said biasing member being a torsion spring;

a stopper coupled to and extending from said arcuate edge of said sheath into said opening of said loop wherein said stopper is positioned to abut said first arcuate section of said cuff when said sheath is biased into a fully extended position;

a locking pin slidably coupled to said first arcuate section of said cuff, said locking pin being slidable between a first position and a second position; and a curved locking slot extending through said first arcuate section, said locking pin being positioned in said locking slot, said locking slot having a first end section and a second end section, said first end section being laterally offset from said second end section such that said sheath is secured in said fully extended position when said locking pin is positioned in said first end section and said sheath is positioned in a fully retracted position when said locking pin is positioned in said second end section of said slot.

* * * * *